US008226188B2

(12) United States Patent
Nishimura

(10) Patent No.: US 8,226,188 B2
(45) Date of Patent: Jul. 24, 2012

(54) IMAGE FORMER

(75) Inventor: Asayo Nishimura, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 277 days.

(21) Appl. No.: 12/815,875

(22) Filed: Jun. 15, 2010

(65) Prior Publication Data

US 2010/0321438 A1 Dec. 23, 2010

(30) Foreign Application Priority Data

Jun. 17, 2009 (JP) ..... P2009-144150

(51) Int. Cl.
*B41J 2/195* (2006.01)

(52) U.S. Cl. ..... 347/7; 347/6; 347/17

(58) Field of Classification Search ..... 347/6, 7, 347/17

See application file for complete search history.

(56) References Cited

U.S. PATENT DOCUMENTS

2009/0322822 A1* 12/2009 Kneezel et al. ..... 347/17

FOREIGN PATENT DOCUMENTS

JP 06-218928 A 8/1994
JP 2007-296754 A 11/2007

* cited by examiner

*Primary Examiner* — Julian Huffman
(74) *Attorney, Agent, or Firm* — The Nath Law Group; Jerald L. Meyer; Stanley N. Protigal

(57) ABSTRACT

An ink discharge unit includes a plurality of nozzles and corresponding ink propelling mechanisms for the nozzles, and configured to discharge ink through the nozzles in accordance with drive signals to drive the ink propelling mechanisms, an ink temperature sensor is adapted to measure a temperature of ink at the ink discharge unit, and a negative-pressure controller is configured to control negative pressures acting on menisci formed in vicinities of the nozzles by surface tension of ink at the ink discharge unit, wherein the negative-pressure controller is configured to work with a discharge of ink by the ink discharge unit, operating for a measured temperature of ink by the ink temperature sensor equal to or higher than a first reference, to control the negative pressures to a first value, and for a measured temperature of ink by the ink temperature sensor lower than the first reference, to control the negative pressures to a second value which is lower than the first value.

8 Claims, 7 Drawing Sheets

PROPELLING AMOUNT : NORMAL
FLYING SPEED : FAST
MIST AMOUNT : LARGE

PROPELLING AMOUNT : NORMAL
FLYING SPEED : SLOW
MIST AMOUNT : SMALL

IMAGE FORMER

BACKGROUND OF THE INVENTION

1. Field of the Invention

The present invention relates to an image former of inkjet type, and particularly to an image former allowing for a printing with a suppressed mist production in a low temperature range.

2. Description of Related Arts

There has been spread use of inkjet type printers including print heads configured with arrays of nozzles through which ink droplets are propelled onto a print sheet to form an image. In inkjet printers, print heads have had their ink propelling mechanisms configured with arrays of piezoelectric devices or such for propelling ink droplets in accordance with applied drive voltages.

In the patent literature 1 (Japanese Patent Application Laid-Open Publication No. H6-218928), there has been description of an ink jet head including nozzles with menisci formed therein in vicinities of the openings by surface tension of ink, causing ink droplets to be propelled with different sizes or flying speeds depending on positions of menisci relative to nozzle openings.

For use in inkjet printers, there have been various kinds of ink available with a typical property tending to have increased viscosities under low-temperature environments, constituting a difficulty to secure an adequate discharge rate with normal drive voltages. To this point, there has been a warm-up of ink at low temperatures, with a pause of print until an arrival at an adequate temperature of ink. Accordingly, a start of printing has been delayed under low-temperature environments, as an issue.

In the patent literature 2 (Japanese Patent Application Laid-Open Publication No. 2007-296754), there has been description of mist (sometimes referred to as satellites) being unnecessary minute ink droplets produced along with ink discharge, adhering to, among others, the printer housing and print sheets, degrading the print quality, as another issue.

SUMMARY OF THE INVENTION

For a printing in a low-temperature environment, one might have applied an increased drive voltage to an ink propelling mechanism for an adequate ink discharge rate to be secured. However, with the increased drive voltage, there might have been an increase in ink discharge speed, increasing the production rate of mist, as well. With an increased mist production rate, the printer housing might have had an increased quantity of mist adhering to walls therein, with anxieties about, among others, flying mist or accumulated mist on walls of the printer housing, making print sheets dirty, degrading the print quality.

It is an object of the present invention to provide an inkjet type image former allowing for a secured ink discharge rate and a printing with a suppressed mist production in a low temperature range.

To achieve the object, according to the present invention, there is an image former comprising: an ink discharge unit including a plurality of nozzles and corresponding ink propelling mechanisms for the nozzles, and configured to discharge ink through the nozzles in accordance with drive signals to drive the ink propelling mechanisms; an ink temperature sensor adapted to measure a temperature of ink at the ink discharge unit; and a negative-pressure controller configured to control negative pressures acting on menisci formed in vicinities of the nodes by surface tension of ink at the ink discharge unit, wherein the negative-pressure controller is configured to work with a discharge of ink by the ink discharge unit, operating for a measured temperature of ink by the ink temperature sensor equal to or higher than a first reference, to control the negative pressures to a first value, and for a measured temperature of ink by the ink temperature sensor lower than the first reference, to control the negative pressures to a second value which is lower than the first value.

DETAILED DESCRIPTION OF THE EMBODIMENTS

Figure 1:
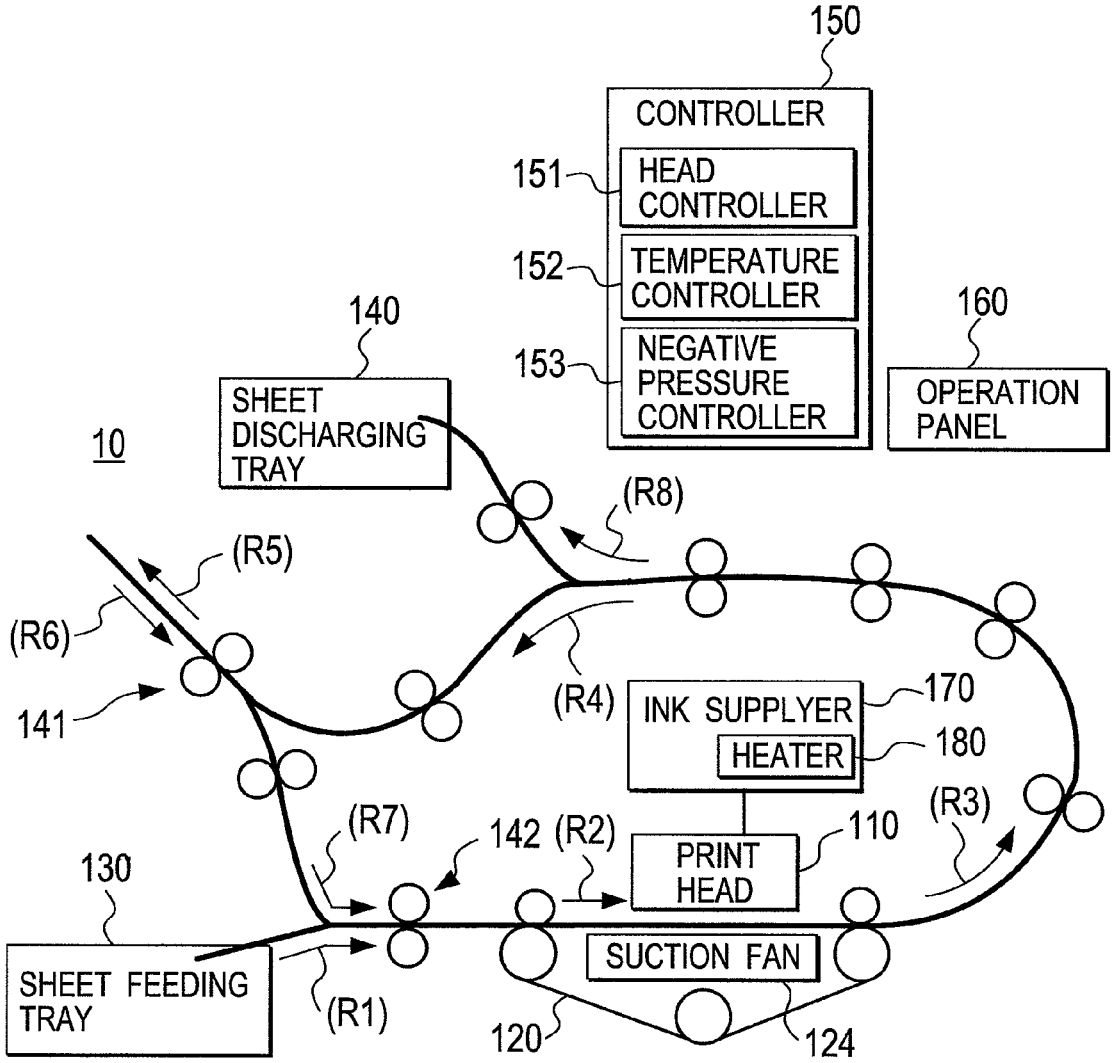
FIG. 1 is a block diagram of configuration of an image former according to the present invention.

Description is made of an embodiment of the present invention, with reference to associated drawings. FIG. 1 is a block diagram of configuration of an image former 10 according to the present invention. The image former 10 according to the present invention is a color printer of inkjet type. As shown in the figure, it includes print heads 110, a transfer belt 120, a suction fan 124, a sheet feeding tray 130, a sheet discharging tray 140, a controller 150, an operation panel 160, an ink supplier 170 including a heater 180, and a plurality of transfer rollers installed along a transfer route, shown in schematic figures.

The print heads 110 are a combination of line inkjet heads corresponding to ink colors. In the present embodiment, it corresponds to ink colors of C (Cyan), K(Black), M(Magenta), and Y(Yellow). Each print head 110 is configured with multiple nodes for propelling ink droplets.

The transfer belt 120 disposed opposite to the print heads 110 has an endless shape and is adapted to transfer a print sheet suctioned with suction power generated by rotations of the suction fan 240. For this purpose, the transfer belt 120 has a perforated transfer surface. In the image former 10, each print head 110 is configured to propel ink droplets from the nozzles formed therein at an appropriate timing onto a print sheet transferred by the transfer belt 120 to form an image thereon. There may be use of a combination of serial inkjet heads instead of line inkjet heads.

The sheet feeding tray 130 is a mechanism for feed of print sheets, and the sheet discharging tray 140 for accumulation of fed print sheets thereon. The present figure shows one for each tray, but there may be ones for each tray. In this case, it is preferable to feed different sizes of print sheets, or to select between face-down and face-up for discharge.

The controller 150 includes a substrate provided with a CPU, a memory, an image processor, etc. for controlling various processes at the image former 10 by, among others, the CPU operating in accordance with a control program stored in the memory.

The controller 150 includes a head controller 151, a temperature controller 152, and a negative-pressure controller 153, as operation parts characterizing the present embodiment. The head controller 151 is configured to generate a set of ink discharge data based on image data to be printed, to output to the head controller 110. The set of ink discharge data may be a set of data on ink droplet numbers per pixel in a cell or line of image, for instance.

The temperature controller 152 is configured to acquire and control temperatures of ink at the print heads 110. Inks have their temperature ranges for guarantee of the print quality The temperature controller 152 is adapted to operate for an acquired temperature of ink lower than a reference temperature, to raise the temperature of ink by heating ink with the heater 180.

The negative-pressure controller 153 is configured to control an ink supplier 170 to adjust negative pressures acting on menisci formed in vicinities of nozzle openings of the print head 110. Specifically, for a printing with inks at low temperatures, values of negative pressures acting on menisci are made lower than those of normal. Reduced negative-pressure values weaken forces of suctioning menisci into the print head 110, and thus positions of menisci are moved toward ink propelling directions. As a result, the size of ink droplets to be propelled becomes larger even with unchanged drive voltages.

Therefore, even at low temperatures, this allows for an ink discharge rate to be secured with drive voltages equal to or not so higher than normal voltages, and ink flying speeds to be suppressed, as well. Suppressed ink flying speeds result in a suppressed quantity of mist. This enables a printing to be performed at low temperatures with suppressed mist production.

The operation panel 160 is configured to display various menu items or information regarding the image former, and accept user operations. For instance, it includes a touch-panel type liquid crystal display, and a plurality of operation buttons, etc.

The ink supplier 170 includes an ink route, a tank, a pump, and the like, and supplies ink from replaceable ink cartridges to the print heads 110. The ink supplier 170 can be an ink circulation type, or an ink non-circulation type. With either type, a control by the negative-pressure controller 153 allows for a change of negative pressures acting on menisci. The ink supplier 170 includes the heater 180 disposed in the ink route for ink heating.

A sheet transfer route forms a circulation route for double-face printing, including a sheet turn over system 141. Upstream of the print heads 110, there is provided a pair of resist rollers 142 for oblique correction and timing adjustment of print sheets.

The sheet feeding tray 130 feeds a print sheet in a direction of arrow (R1) to temporarily stop the sheet at the resist rollers 142. Then the resist rollers 142 transfer the sheet to the transfer belt 120 provided opposite to the print heads 110.

The transfer belt 120 transfers the sheet being suctioned thereon in a direction of arrow (R2), while the print heads 110 form an image by line on a face side of the sheet. Then the transfer belt 120 transfers the sheet along the transfer route in a direction of arrow (R3), and a group of rollers aligned along the transfer route further transfer the sheet. It is noted that the group of rollers is controlled by the controller 150 to be rotary driven by a not shown drive mechanism.

For one side printing, a finished print sheet is led in a direction of arrow (R8) to be discharged to the discharge tray 140. For both side printing, a print sheet after face printing is led in a direction of arrow (R7) without being discharged to the discharge tray 140. Then the sheet is pulled in a direction of arrow (R5) by the sheet turnover system 141 to be temporarily stopped.

Afterward, the print sheet is transferred in a direction of arrow (R6) by the sheet turnover system 141 to be turned over for the inkjet heads 110. Further, the sheet is transferred in a direction of arrow (R7) to be stopped at the resist rollers 142 for oblique correction and timing adjustment. Then, as same in the face printing, after an image formation on back side with the inkjet heads 110, the sheet is led from a direction of arrow (R3) to a direction of arrow (R8) to be discharged to the discharge tray 140.

Figure 2:
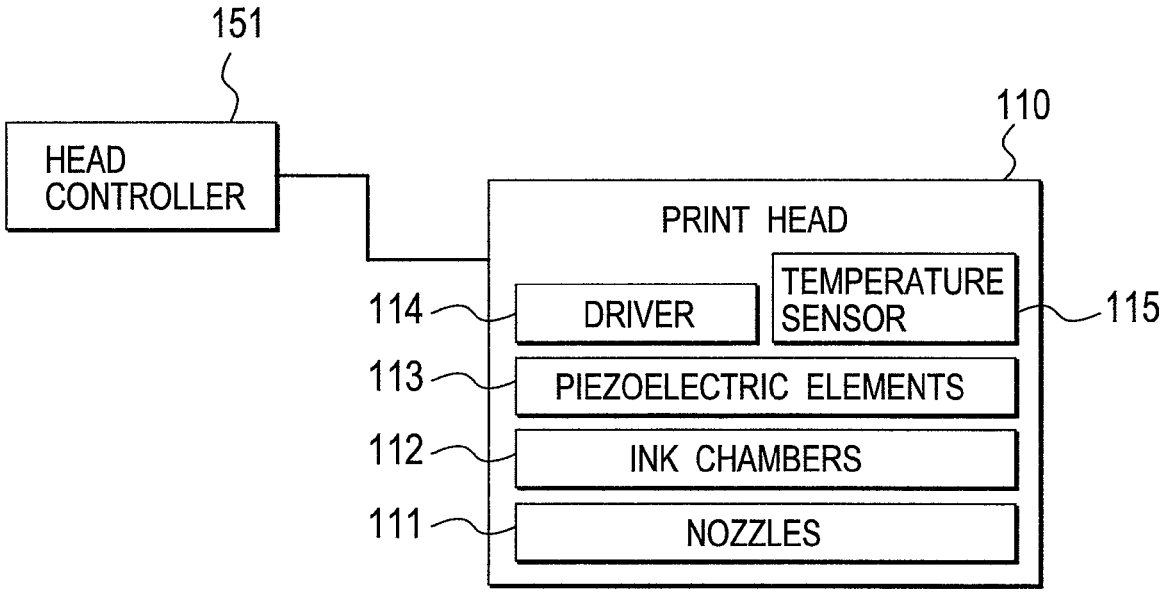
FIG. 2 is a block diagram of configuration of combination of a print head and a head controller.

FIG. 2 is a block diagram to show a configuration of related elements to an inkjet head 110. As shown in the figure, the inkjet head 110 is controlled by the head controller 151, and includes a nozzle 111, an ink chamber 112, a piezoelectric element 113, a driver 114, and a temperature sensor 115. The print head 110 has multiple nozzles 111 formed thereon, and an ink chamber 112 and a piezoelectric element 113 provided for each nozzle 111.

The ink chamber 112 constitutes part of the ink route, and is supplied with ink by the ink supplier 170. The piezoelectric element 113 is disposed over the ink chamber 112. The driver 114 outputs drive signals to the piezoelectric elements 113 based on ink discharge data sent from the head controller 151. The piezoelectric element 113 changes shape based on a drive signal, to propel an ink droplet through the nozzle 111 formed on one end of the ink chamber 112. The temperature sensor 115 is adapted to measure a temperature of ink supplied for distribution to the ink chambers 112 directly or indirectly.

There may be use of an ink propelling mechanism with a heating element for heating ink, to produce bubbles, to eject ink.

Description is now made of print control actions by the image former 10 according to the present embodiment. In the present embodiment, there is a lower limit of an adequate range of temperatures of ink set as a first reference temperature. The first reference temperature may well be 25° C., for instance. When a temperature of ink is lower than 25° C., the temperature controller 152 operates the heater 180 to warm up ink.

If a printing is not executed until the temperature of ink arrives at 25° C. or more, a start of printing is delayed at low temperatures. In this regard, there is a second reference temperature to be set. If a user prefers an early start of printing at low temperatures, a printing is executed when the temperature of ink is equal to or higher than the second reference temperature. A user can change a setting for early start of printing through a printer driver on a printer host on which print directions are made, for instance. Or, there may be use of the operation panel 160 on the image former 10 through which the setting is changed. Further, an administrator may set as default whether or not to execute early printings.

The second reference temperature is lower than the first reference temperature, and may be 20° C., for instance. It is noted that inks have increased viscosities at a temperature lower than the first reference temperature, constituting a difficulty to secure an adequate discharge rate. To this point, one might have had drive signals with voltage values increased higher than normal values, to be output to the piezoelectric elements 113, for the adequate ink discharge rate to be secured.

However, if drive voltages are increased enough to secure the adequate ink discharge rate, ink flying speeds are also increased, increasing the production rate of mist. With an increased mist production rate, print sheets might have had an increased quantity of mist attached thereto, degrading the quality of printing, as a problem.

Figure 3:
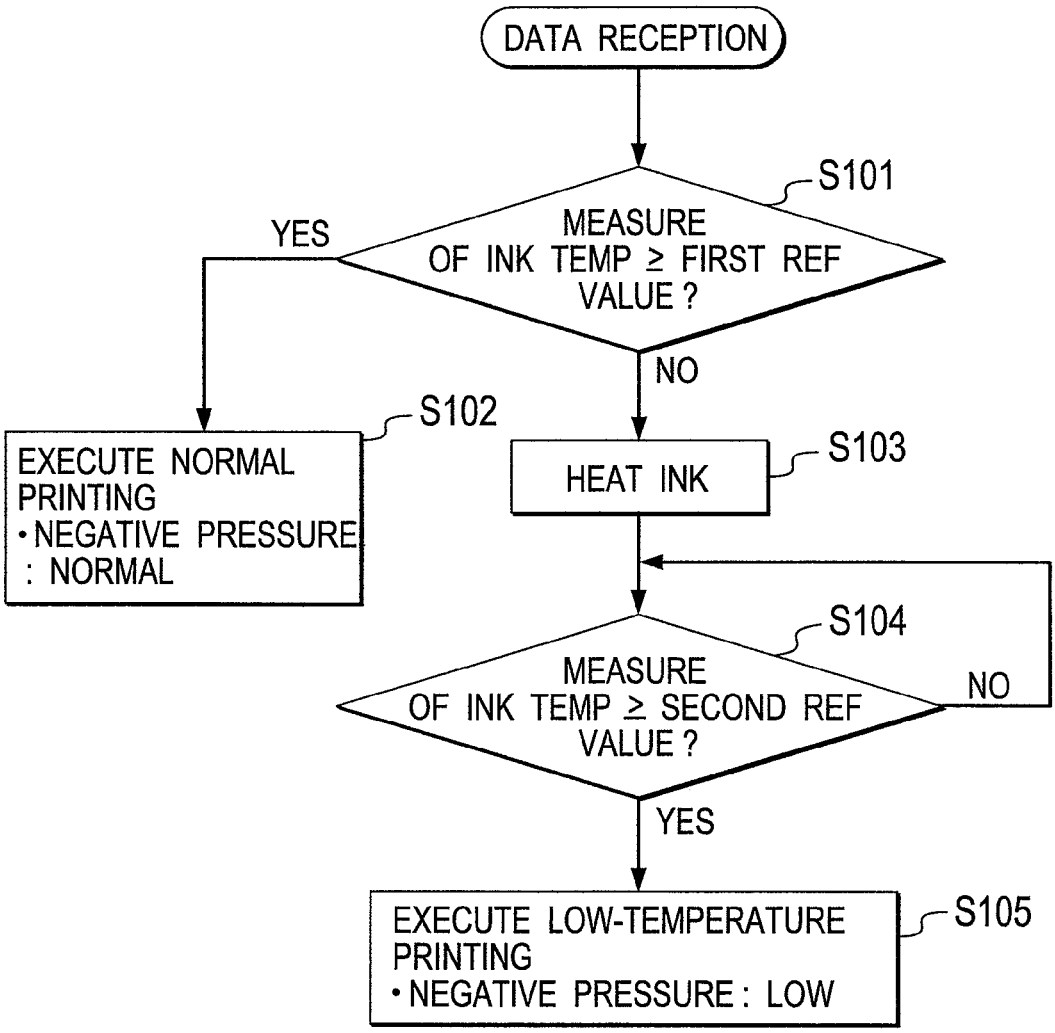
FIG. 3 is a flowchart of control actions for print execution at an image former according to an embodiment of the present invention.

In this regard, according to the present embodiment, there are print control actions to be executed as shown by a flowchart in FIG. 3. There will be eliminated redundancy in description associated with an adequate ink temperature range or higher. There is a direction given by a user for a print execution in a low temperature state.

At first, if a measured temperature of ink by the temperature sensor 115 equals to or higher than the first reference temperature, 25° C. or more, for instance (Yes at the step S101), it is determined as in an adequate temperature range, and thus a normal print action is executed (S102). If measured temperatures are varied for every ink color, there may be an average of ink temperatures, or a lowest temperature chosen as a reference, to be based on for determination.

In the normal print action, the negative-pressure controller 153 gives normal negative pressures on menisci. The driver 114 outputs drive signals with normal voltage values to the piezoelectric elements 113, which secure an adequate ink discharge rate with normal negative pressures within an adequate temperature range.

On the other hand, if a measured temperature of ink is lower than the first reference temperature, for example under 25° C. (No at the step S101), the temperature controller 152 operates the heater 180 to heat ink for a raise to an adequate temperature (S103).

After the start of ink heating, if a measured temperature of ink is still lower than the second reference temperature, for example under 20° C. (No at the step S104), there is a pause without starting printing until the temperature of ink is raised up to the second reference temperature.

If a measured temperature of ink is equal to or higher than the second reference temperature and lower than the first reference temperature, or raised up to the second reference temperature or more by heating (Yes at the step S104), a print action at low temperatures is executed (S105). In the print action at low temperatures, the negative-pressure controller 153 gives negative pressures lower than those of normal on menisci. The driver 114 outputs drive signals to the piezoelectric elements 113 with voltage values equal to, or slightly higher than a normal value as necessary.

Figure 4A:
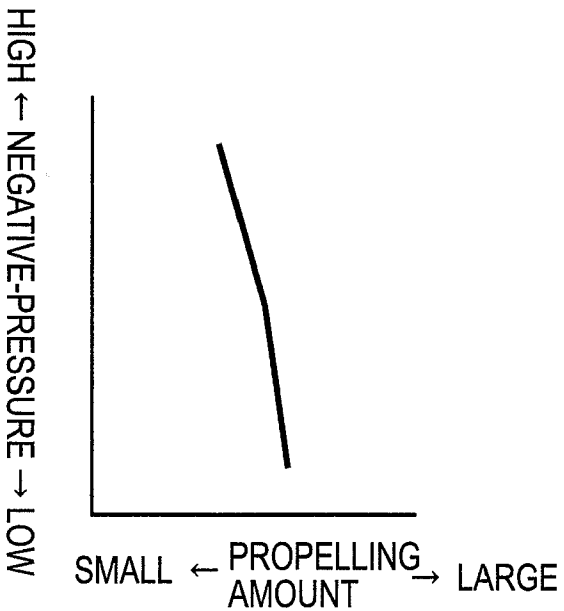
FIG. 4A is a graph representing a relationship between negative pressures acting on menisci and an ink discharge rate.
Figure 4B:
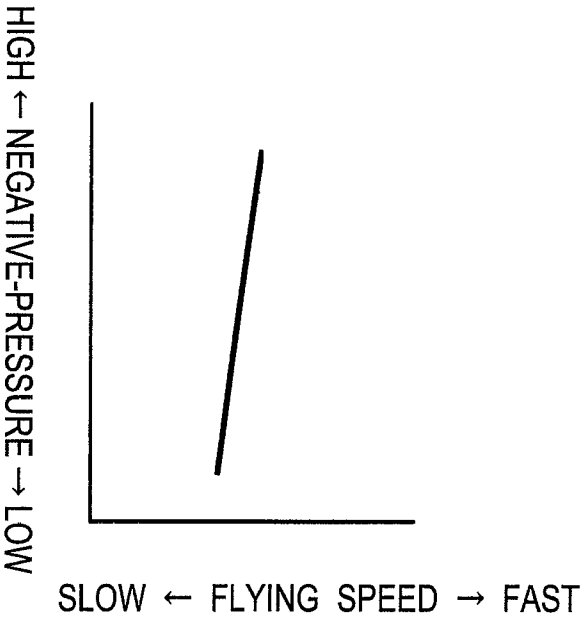
FIG. 4B is a graph representing a relationship between negative pressures acting on menisci and ink flying speeds.

Description is now made of reasons for negative pressures lower than those of normal, given on menisci, in the print action at low temperatures. FIG. 4A shows in a graph a relationship between negative pressures acting on menisci and an ink discharge rate. FIG. 4B shows in a graph a relationship between negative pressures acting on menisci and ink flying speeds. In both graphs, temperatures of ink and voltage values given to signals applied to piezoelectric elements are equal, respectively. As shown in FIGS. 4A and 4B, reduced negative pressures acting on menisci cause the ink discharge rate to increase and on the other hand flying speeds to become slower. It is noted that negative pressures acting on menisci produces forces to suction ink in opposite directions to ink propelling directions.

Figure 5A:
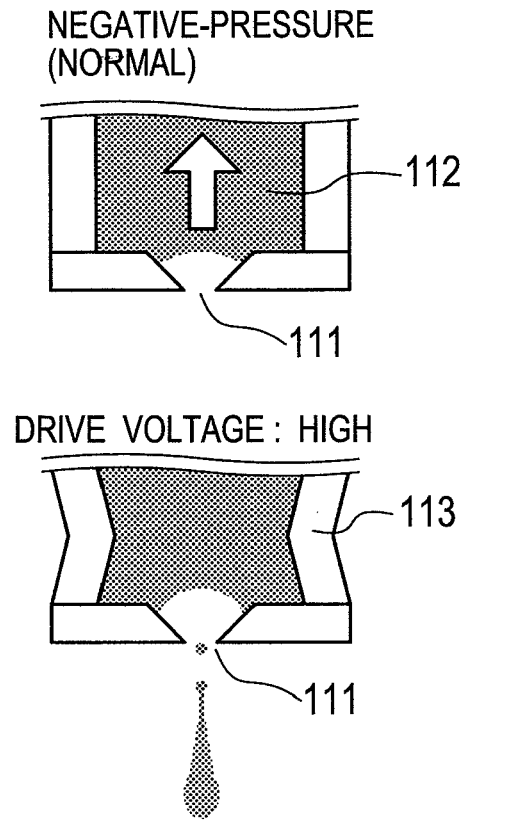
FIG. 5A is a diagram of ink discharge with a normal negative pressure acting on a meniscus.
Figure 5A:
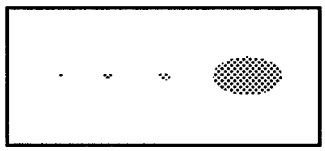
Figure 5B:
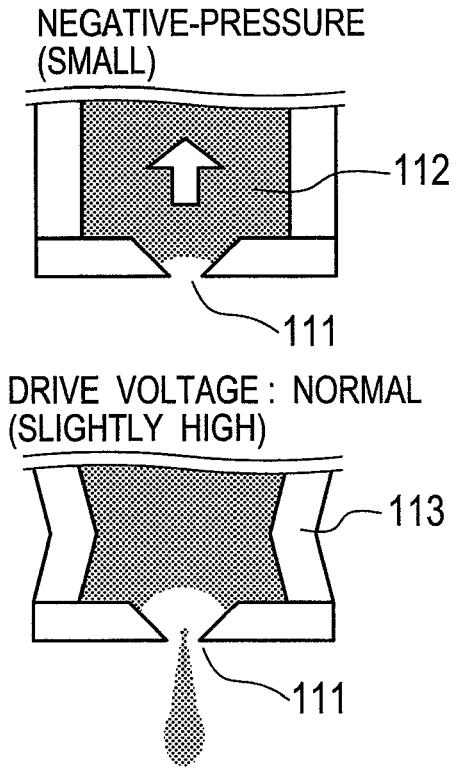
FIG. 5B is a diagram of ink discharge with a negative pressure lower than that of normal, acting on a meniscus.
Figure 5B:
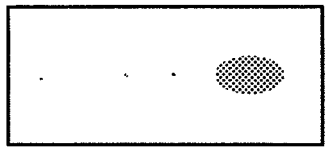

FIG. 5A shows an ink discharge with a normal negative pressure acting on a meniscus, and FIG. 5B shows an ink discharge with a negative pressure lower than that of normal, acting on a meniscus. Both diagrams show that at low temperatures. For a normal ink discharge rate to be secured, a drive voltage is increased in FIG. 5A, and a negative pressure is decreased in FIG. 5B.

As shown in the top column of FIGS. 5A and 5B, with a reduced negative pressure acting on a meniscus formed in a vicinity of the nozzle 111, a force suctioning meniscus is weakened, thereby moving the meniscus to a discharge direction (downside in the figure). The middle column of FIGS. 5A and 5B show the piezoelectric elements 113 made to change shapes to propel droplets from nozzles 111. It is noted that a piezoelectric element 113 may change shape on only one side of the ink chamber.

As shown in FIG. 5A, an increased voltage with a normal negative pressure permits to secure a normal discharge rate, but increases an ink flying speed. As a result, as shown in the bottom of the figure, there is an increased quantity of mist (small droplets in the figure) attached around a main droplet (largest droplet in the figure).

On the other hand, as shown in FIG. 5B, a decreased negative pressure permits to secure a normal discharge rate, while decreasing an ink flying speed. As a result, as shown in the bottom of the figure, there is less quantity of mist attached around a main droplet. It is noted that if a normal discharge rate is not secured by a reduced negative pressure, the drive voltage may be raised. In this case, there is a still smaller raise in drive voltages than that necessitated to secure a normal discharge rate with a normal negative pressure. On the other hand, if a discharge rate equal to or more than a normal discharge rate is secured with a decreased negative pressure, the drive voltage may be decreased. In either case, a reduced amount of voltage can be expended for electricity for the heater 180.

As a negative-pressure value changes positions of meniscus and the discharge rate, there may be a reduction of negative-pressure value based on temperatures of ink. That is, as the temperature of ink becomes lower, the negative-pressure value given on a meniscus is made smaller. This is because of increased viscosity of ink under a low-temperature environment, constituting a difficulty to secure an adequate droplet amount. Further, for a property of ink temperature different in every ink color or ink type, there may be a change of at least one of the negative pressure value, the first reference temperature, and the second reference temperature, to be varied in correspondence to ink colors or ink types.

It is noted that too decreased negative pressure may cause a drop of ink from the nozzle 111. Thus, a negative-pressure value should be set equal to or higher than a lower limit defined by an ink viscosity, surface tension, or the like.

Figure 6:
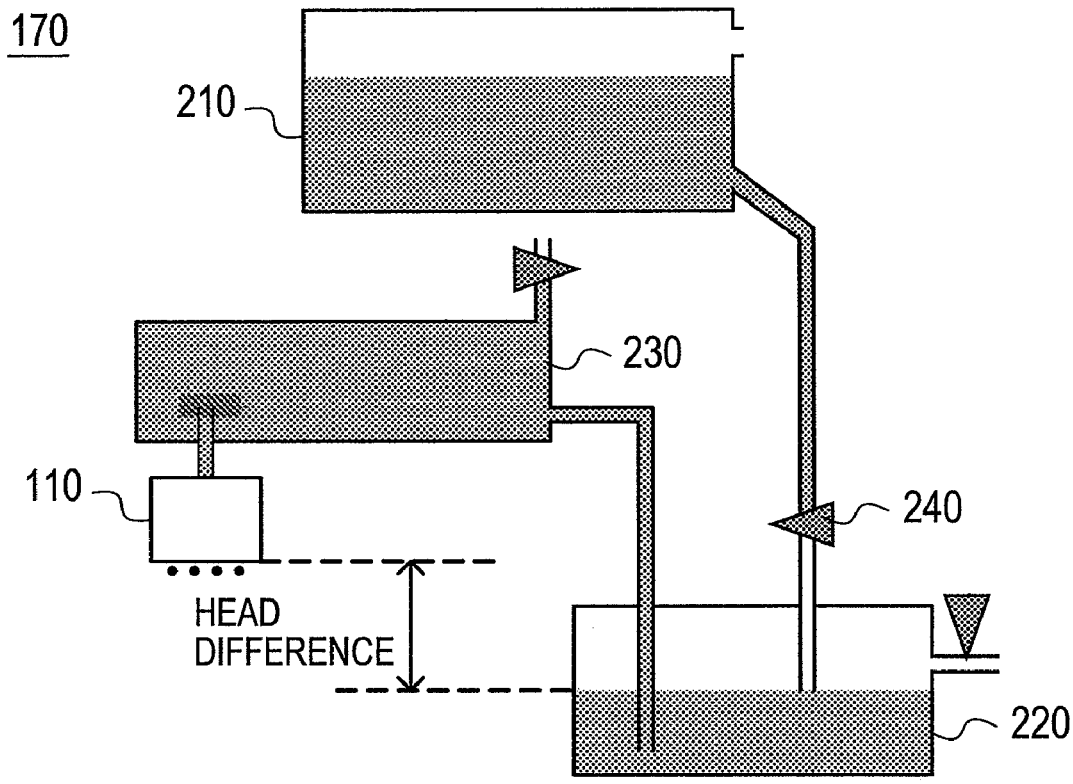
FIG. 6 is a diagram of a method for negative-pressure adjustment by an ink supplier in accordance with controls by a negative-pressure controller, when the ink supplier employs an ink route of non-circulation type.

Description is now made of a method for adjusting negative pressures by the ink supplier 170 in accordance with control actions of the negative-pressure controller 153. FIG. 6A illustrates a use of non-circulation type ink route by the ink supplier 170. In this example, ink is supplied from a pressure-released ink bottle 210 to an ink tank 220, and sent to a print head 110 through a unit 230. The ink tank 220 is disposed at a position at which a liquid level is lower than that of the print head 110.

In this case, negative pressures acting on menisci formed in vicinities of nozzle openings of the print head 110 are given by a head difference between a level of nozzles and a liquid level of the ink tank 220. Specifically, negative pressures are increased by increasing the head difference, and decreased by decreasing the head difference. Accordingly, for reduction of negative pressures, a liquid level of the ink tank 220 should be raised.

The negative-pressure controller 153 controls a valve 240 for adjusting an ink flow from the ink bottle 210 into the ink tank 220, thereby varying a liquid level of the ink tank 20 for control of negative pressures acting on menisci. There may be use of a configuration to move the ink tank 220 up and down to vary a head difference for control of negative pressures acting on menisci.

Negative pressures acting on menisci can be calculated from a density of ink, or the like, for instance. Adjustment of a head difference based on the calculation permits to control negative pressures acting on menisci.

Figure 7:
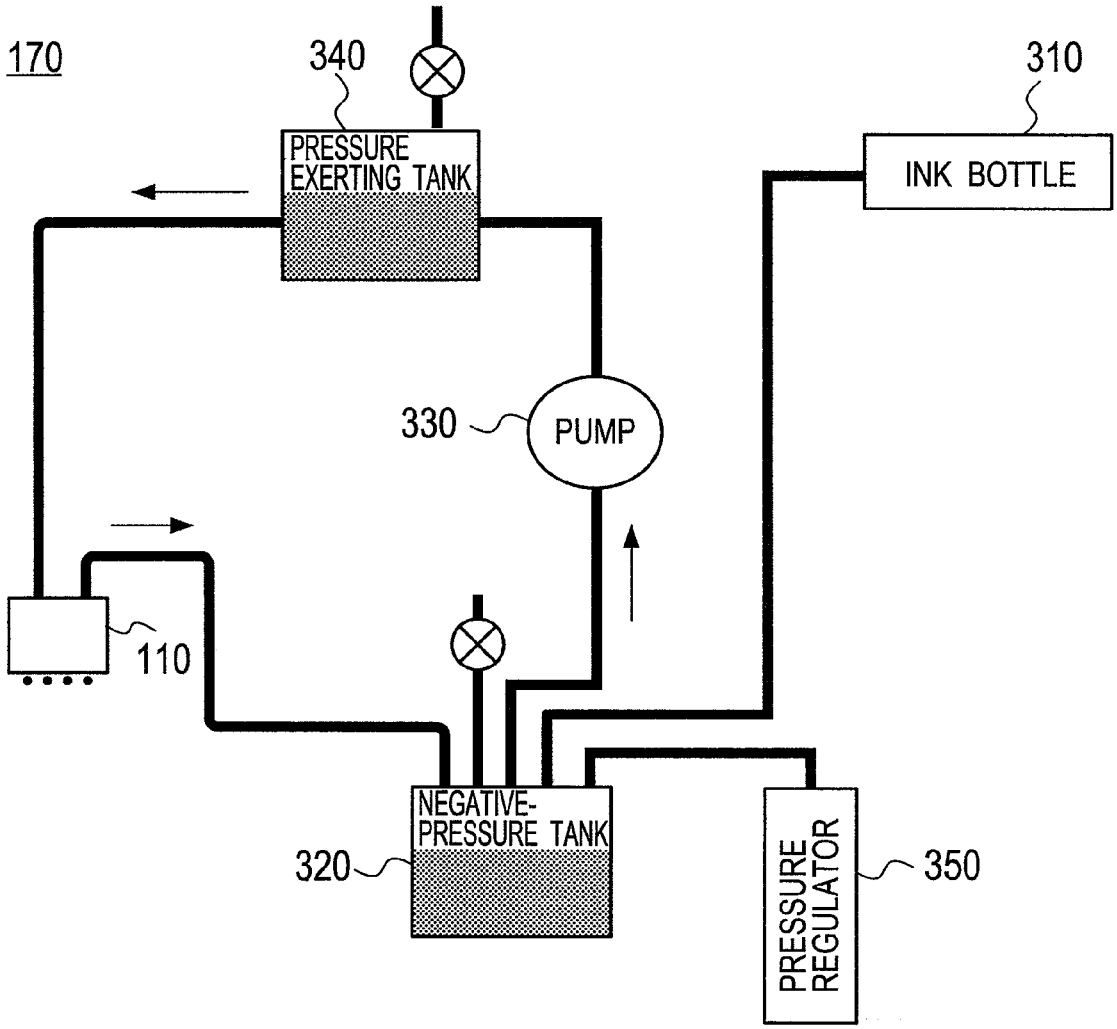
FIG. 7 is a diagram of a method for negative-pressure adjustment by an ink supplier in accordance with controls by a negative-pressure controller, when the ink supplier employs an ink route of circulation type.

FIG. 7 is an example of use of an ink circulation type ink route by the ink supplier 170. In the example, ink is supplied from an ink bottle 130 to a negative-pressure tank 320, and then sent to a pressure-exerting tank 340 by a pump 330, where it is supplied to a print head 110. Unused ink at the ink head 110 in a printing is returned to the negative-pressure tank 320. As described, in the ink circulation type ink route, ink is circulated by actions of pump 330.

In this case, negative pressures acting on menisci formed in vicinities of node openings of the print head 110 are adjusted by a pressure regulator 350 provided to the negative-pressure tank 320. For the pressure regulator 350, there may be use of bellows, a bellows elevating mechanism, a bellows type pressure regulator configured of a weight etc. There may be a pressure meter disposed between the print head 110 and the negative-pressure tank 320, to detect negative pressures for control of the pressure regulator 350.

As described, in the present embodiment, reducing negative pressures acting on menisci, permits to secure an ink discharge rate at low temperatures where inks have increased viscosities and prevents flying speeds from being increased. This permits a printing with a suppressed mist production at low temperatures. It is noted that specific negative-pressure values, reference temperatures, and the like, are defined experimentally and theoretically, based on configurations of the print head 110, the ink supplier 170, or the like.

The present invention provides an inkjet type image former permitting a secured ink discharge rate at low temperatures and a printing with a suppressed mist production.

While preferred embodiments of the present invention have been described using specific terms, such description is for illustrative purposes, and it is to be understood that changes and variations may be made without departing from the spirit or scope of the following claims.

The present application claims the benefit of priority under 35 U.S.C.§119 to Japanese Patent Application No. 2009-144150, filed on Jun. 17, 2009, the entire contents of which are incorporated herein by reference.

What is claimed is:

1. An image former comprising:

an ink discharge unit including a plurality of nozzles and corresponding ink propelling mechanisms for the nozzles, and configured to discharge ink through the nozzles in accordance with drive signals to drive the ink propelling mechanisms;

an ink temperature sensor adapted to measure a temperature of ink at the ink discharge unit; and a negative-pressure controller configured to control negative pressures acting on menisci formed in vicinities of the nozzles by surface tension of ink at the ink discharge unit, wherein the negative-pressure controller is configured to work with a discharge of ink by the ink discharge unit, operating for a measured temperature of ink by the ink temperature sensor equal to or higher than a first reference, to control the negative pressures to a first value, and for a measured temperature of ink by the ink temperature sensor lower than the first reference, to control the negative pressures to a second value which is lower than the first value.

2. The image former according to claim 1, further comprising:

a drive signal output interface configured to output drive signals to drive the ink propelling mechanisms, wherein the drive signal output interface is adapted to operate for the negative pressures having the second value, to output drive signals to drive the ink propelling mechanisms with voltage values less than those of drive signals to drive the ink propelling mechanism for the negative pressures having the first value.

3. The image former according to claim 1, further comprising:

a heater adapted to heat ink; and a temperature controller configured to work for a measured temperature of ink by the temperature sensor lower than a second reference which is lower than the first reference, prior to a discharge of ink by the ink discharge unit, to heat ink with the heater.

4. The image former according to claim 3, wherein the ink discharge unit is adapted to work for a measured temperature of ink equal to or higher than the second reference by the heating, to start a discharge of ink.

5. The image former according to claim 3, wherein the image former is adapted to change at least one of the second value, the first reference, and the second reference, in accordance with a property of ink discharged by the ink discharge unit.

6. The image former according to claim 1, further comprising:

an ink tank configured to supply ink to the ink discharge unit, wherein the negative-pressure controller is adapted to adjust a head difference between a liquid level of the ink tank and a nozzle level, to control negative pressures acting on menisci.

7. The image former according to claim 1, further comprising:

a negative-pressure generator configured to generate negative pressures acting on menisci, wherein the negative-pressure controller is adapted to adjust the negative-pressure generator to control negative pressures acting on menisci.

8. The image former according to claim 1, wherein the negative-pressure controller is adapted to change the second value based on a measured temperature of ink by the ink temperature sensor.

* * * * *